US010040063B2

(12) United States Patent
Scagliarini et al.

(10) Patent No.: US 10,040,063 B2
(45) Date of Patent: Aug. 7, 2018

(54) METHOD FOR PRODUCING A MINI-VIAL WITH A REDUCED NUMBER OF COMPONENTS AND THE MINI-VIAL THUS OBTAINED

(71) Applicant: GVS S.P.A., Zola Predosa (IT)

(72) Inventors: Massimo Scagliarini, Casalecchio di Reno (IT); William Pandolfo, Covolo (IT)

(73) Assignee: GVS S.P.A., Zola Predosa (BO) (IT)

( * ) Notice: Subject to any disclaimer, the term of this patent is extended or adjusted under 35 U.S.C. 154(b) by 0 days.

(21) Appl. No.: 15/021,147

(22) PCT Filed: Sep. 8, 2014

(86) PCT No.: PCT/IB2014/064306

§ 371 (c)(1),
(2) Date: Mar. 10, 2016

(87) PCT Pub. No.: WO2015/036909

PCT Pub. Date: Mar. 19, 2015

(65) Prior Publication Data

US 2016/0220991 A1 Aug. 4, 2016

(30) Foreign Application Priority Data

Sep. 11, 2013 (IT) ..... MI2013A1502

(51) Int. Cl.
*B01L 3/00* (2006.01)

(52) U.S. Cl.
CPC ..... *B01L 3/502* (2013.01); *B01L 3/508* (2013.01); *B01L 3/5082* (2013.01);
(Continued)

(58) Field of Classification Search
CPC .... B01L 3/502; B01L 3/502707; B01L 3/508; B01L 3/5082; B29C 45/14
(Continued)

(56) References Cited

U.S. PATENT DOCUMENTS 6,123,905 A * 9/2000 Torti ..... B01L 3/021 422/513
7,790,117 B2 9/2010 Ellis et al.
(Continued)

FOREIGN PATENT DOCUMENTS

DE 102006049560 A1 4/2008
WO 2009031171 A1 3/2009
WO 2012085006 A1 6/2012

OTHER PUBLICATIONS

International Search Report and Written Opinion dated Jun. 3, 2014 for PCT/IB2014/064306 to GVS S.P.A. filed Sep. 8, 2014.

*Primary Examiner* — Jill A Warden
*Assistant Examiner* — Jacqueline Brazin
(74) *Attorney, Agent, or Firm* — Vorys, Sater, Seymour and Pease LLP

(57) ABSTRACT

A method for producing a mini-vial of the type including a tubular container or vial, closed at a first end and open at its second end and capable of containing a product in fluid phase, a plunger sealingly movable in the vial through the second end and having an internal cavity capable of receiving the fluid from the vial, the plunger having a first end on which is placed a sealing cap and a second end movably slidable in the vial and at which is located a membrane filter, the plunger and vial being obtained by molding; the plunger being envisaged as overmolded onto the filter located at its second end, the membrane filter forming a single body with the plunger.

20 Claims, 2 Drawing Sheets

(52) U.S. Cl.
CPC ..... *B01L 3/502707* (2013.01); *B01L 2200/12* (2013.01); *B01L 2300/042* (2013.01); *B01L 2300/0681* (2013.01); *B01L 2300/0832* (2013.01); *B01L 2400/0478* (2013.01)

(58) Field of Classification Search
USPC ..... 422/534; 264/250, 259, 279
See application file for complete search history.

(56) References Cited

U.S. PATENT DOCUMENTS

| | | | | |
|---|---|---|---|---|
| 7,790,197 | B2 | 9/2010 | Fergione et al. | |
| 8,202,495 | B1 * | 6/2012 | Smith | B01L 3/0275 422/500 |
| 2007/0287193 | A1 * | 12/2007 | Pressman | B01D 61/18 436/178 |
| 2009/0238725 | A1 * | 9/2009 | Ellis | B01L 3/502 422/400 |
| 2010/0185135 | A1 * | 7/2010 | Scagliarini | A61M 1/3639 604/6.09 |
| 2013/0270173 | A1 * | 10/2013 | Tortorella | B01L 3/502 210/416.1 |
| 2015/0266019 | A1 * | 9/2015 | Longenbach | B01L 3/5082 422/527 |

* cited by examiner

METHOD FOR PRODUCING A MINI-VIAL WITH A REDUCED NUMBER OF COMPONENTS AND THE MINI-VIAL THUS OBTAINED

This invention relates to a method for producing a mini-vial and a mini-vial thus obtained, according to the pre-characterising clause of the respective independent claims.

As is known, a mini-vial has a tubular plunger having a first end to which is connected a cap and a second end where a filtering membrane is present. The plunger can be inserted with its second end into a cylindrical body, through a first open end of the latter, the second end of this body being closed.

The cylindrical body contains a fluid and, in general, particles present therein. When the tubular plunger penetrates into the cylindrical body (functioning as a vial) so that a seal is formed between the internal wall of the latter and the external wall of the plunger so as not to cause the above-mentioned fluid to escape, the fluid passes through the filter and penetrates into the plunger.

The fluid thus filtered can then be extracted from the plunger for further use by separating the cap located at its first end or by means of a syringe needle that punctures this cap.

In order to obtain a perfect seal between the plunger and the vial, these components are produced, by moulding, so that the internal diameter of the vial and the external diameter of the plunger have very similar values. Furthermore, near its second end, the plunger has a protruding collar that interferes with the internal wall of the vial ensuring the required seal and preventing the fluid in the vial from escaping between the surfaces of the latter and of the plunger.

It is known to associate the membrane filter with an annular support body open at both of its opposing ends. At one of the latter, a series of radially arranged arms connected at one of their ends along the axis of said body and at the other end to the said body hold the filter in this body before the latter connects with the second end of the plunger.

The support body must be placed on and fixed to the plunger after the membrane filter has been positioned therein.

This connection occurs, according to known methods, by performing an ultrasonic welding operation, which however can release particles that may pollute the fluid contained in the vial when said fluid passes through the filter.

U.S. Pat. No. 7,790,197 describes a different method of connection between the support body of the filter and the plunger, a method that involves producing this body and the second end of the plunger of the appropriate dimensions and shapes and forcing said body onto said end so as to fix it thereto. Due to the deformation of the parts in contact and the pressing action of an edge part of the end of the plunger on an internal step of the support body of the filter, a mechanical connection is achieved between them so as to secure the filter to the plunger without releasing particles that could pollute the fluid of the vial during its passage through the filter.

This solution involves a plurality of production steps that are not easy to perform, also considering the small size of the mini-vial parts (support body and filter). Furthermore, the mechanical connection could always deform the filter or damage it so that its filtering qualities are at least partially limited, which cannot be detected after the parts have been secured together.

In addition, the individual production of these parts involves the use of special machines, which increases the cost of the product.

Lastly, the above-described known solution creates a volume that is "dead" or not usable for filtering the fluid during its passage from the vial to the plunger due to the membrane filter being positioned far away from the free end of the plunger because between the latter and said filter the radial part of the annular support body is present.

WO 2012/085006 A1 describes a filtering device for use in the filtration of a liquid and discloses: a liquid receptacle having an open and a closed end; a plunger body movable at least partially within the liquid receptacle along an axis thereof, said axis extending between the above-mentioned ends, said plunger including a filtrate chamber in fluid communication with the liquid receptacle via a fluid filtering path and a filter arranged therein. This device also includes a slidable seal for inhibiting or preventing fluid flow across the seal during the movement of the plunger. This seal including a first skirt which extends from the plunger at one end of the first skirt, the latter having an outer surface which in use slidably and sealingly abuts the vial, and having, at least in an uncompressed state, a generally annular separation between the skirt and the plunger body, which separation extends generally parallel to the above-mentioned axis. A second skirt, overlapping the first, is also disclosed in this patent.

This prior art (from which the pre-characterising clause of the main claim derives) discloses that the filter is held connected to the body of the plunger by a retaining ring that can fix the filter by interference-, snap-fit or suchlike. Alternatively, the ring can be secured to the above-mentioned body by ultrasonic welding, thus holding the filter fixed on said body.

The above-mentioned prior art, therefore, discloses that the filter is connected to the body of the device always and only by means of a mechanical connection made after bringing the parts close together and ensuring their appropriate mutual arrangement. Only after this operation is there a gluing or welding between the retaining ring and the body of the device, with consequent securing of the filter thereto.

Thus, in the prior art, the filter is always and in any case a separate body from the device, that is it does not form with it a single, inseparable body.

In addition, WO 2012/085006 discloses no element to which the filter is superficially and inseparably connected so as to protect it from deformations when the device is being used.

Neither is this last characteristic disclosed or suggested by U.S. Pat. No. 8,202,495 and WO 2009/031171, which relate to devices that in any event differ from the subject matter of this invention.

The aim of the present invention is to offer a method for producing a mini-vial adopting methods that allow the number of its parts to be reduced, resulting in less use of special machinery compared to the state of the art and therefore lower production costs while ensuring correct positioning of the filter in the plunger and thus optimum filtration of the fluid present in the vial.

Another aim is to offer a method for obtaining a mini-vial that has a lower implementation cost than those of the known methods, with a consequent lower cost of the finished product.

Yet another aim is to offer a method for producing a mini-vial that, during its operation, does not release particles which, during use of the finished product, can pollute the fluid contained therein, said mini-vial thus guaranteeing considerable safety of use.

A further aim of the invention is to offer a method that enables a mini-vial to be obtained where the dead space for fluid filtration is reduced to a minimum value, practically zero, which allows all of the fluid in the vial to be filtered when the plunger is fully inserted therein.

Another aim is to offer a mini-vial in which the filter is adequately supported during the introduction of the plunger in the vial so as to be able sufficiently to resist the pressure exerted thereon by the fluid during this movement.

These and other aims, which will be obvious for a person skilled in the art, will be achieved by a method and by a mini-vial according to the accompanying claims.

A better understanding of the present invention will emerge more clearly from the following accompanying drawings, given merely by way of a non-limiting example, in which.

Figure 1:
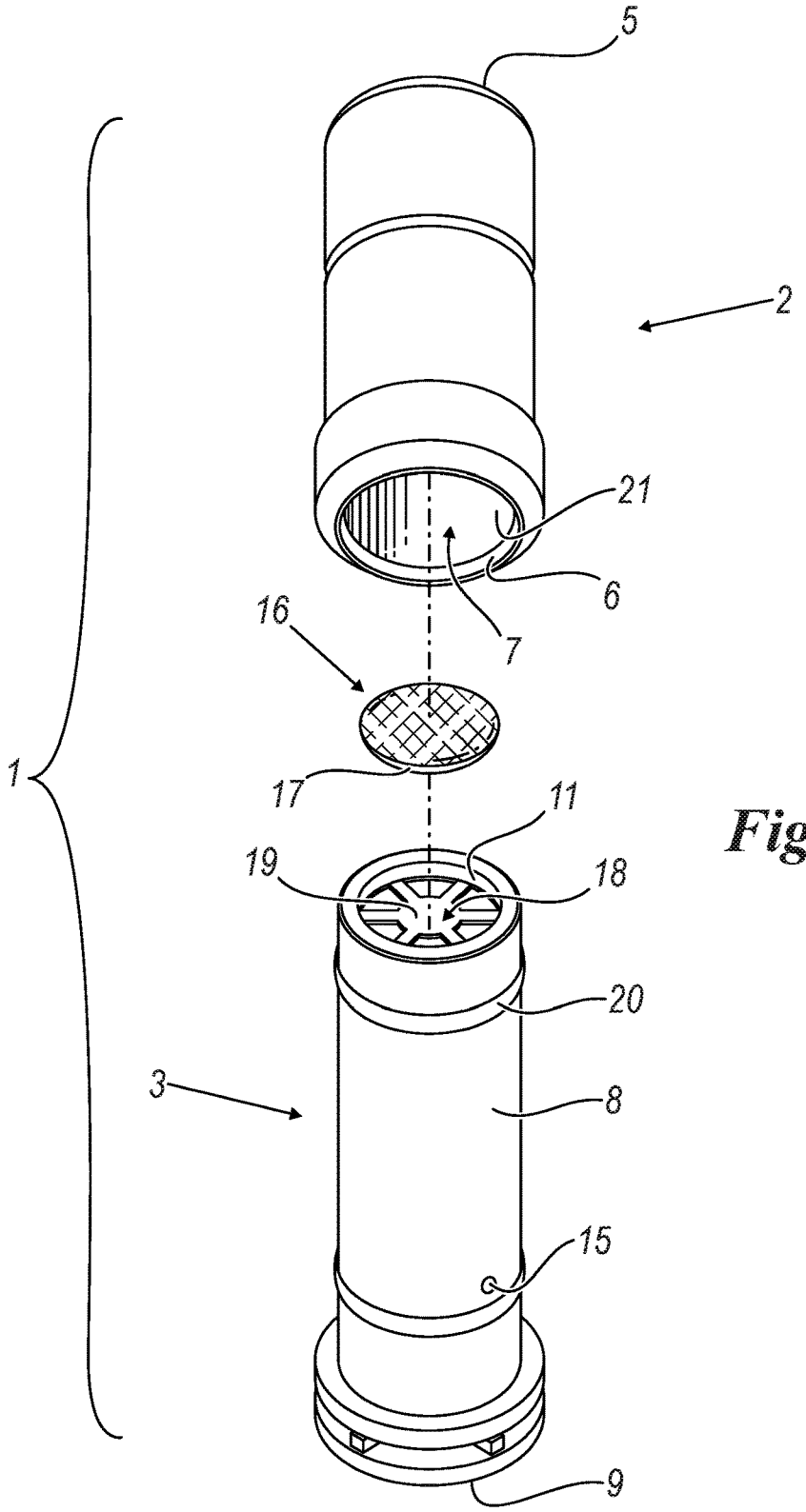
FIG. 1 is an exploded perspective view of a mini-vial obtained according to the invention.
Figure 2:
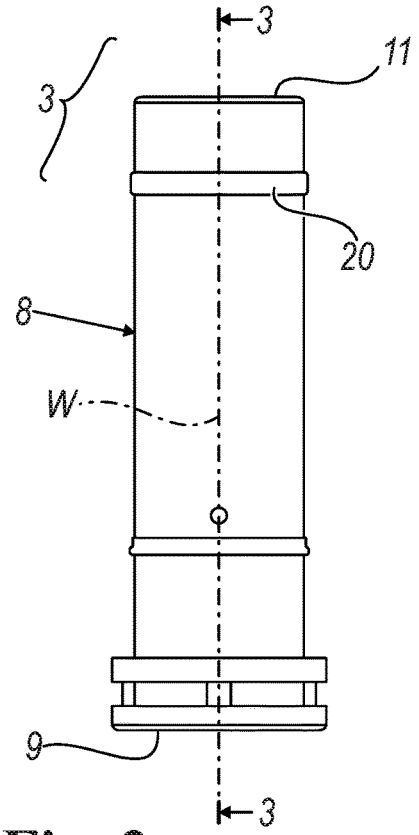
FIG. 2 is a front view of a part of the mini-vial in FIG. 4.
Figure 3:
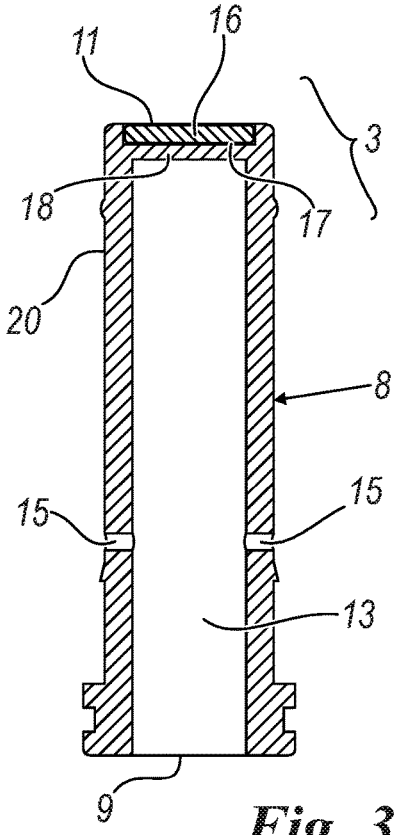
FIG. 3 is a cross-sectional view along Line 3-3 in FIG. 2.
Figure 4:
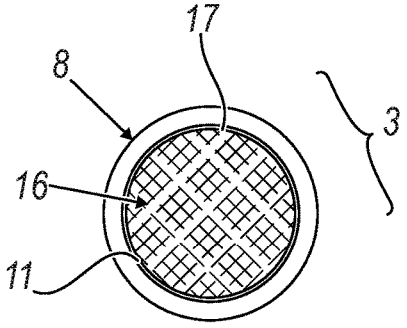
FIG. 4 is a top view of the part of the mini-vial in FIG. 1.

The drawings are not to scale, FIG. 1 showing in a larger scale that shown in FIGS. 2-4.

With reference to said drawings, a mini-vial is shown generally by 1 and comprises a vial 2 capable of containing a fluid and a plunger 3. The vial 2 has a first closed end 5 and a second open end 6 that allows the plunger 3 access into one of its internal cavities 7 capable of containing a fluid, such as a medical fluid.

The plunger 3 has a tubular body 8 having a first end 9 capable of accommodating a cap (not shown) and a second end 11.

The cap can be forcibly connected to the first end 9 or the latter can have a conformation such as to enable a bayonet connection to the cap (appropriately shaped for this purpose). According to another variation, the first end 9 of the body 8 can be (internally or externally) threaded and the cap has a corresponding conformation so as to connect to said end by screwing.

Between these ends is a cavity 13 (inside the plunger) provided with vent holes 15 advantageously coaxial and opposing arranged slightly towards the first end 9 (in the example, there are two such holes, but there may also be just one hole 15). The holes 15 can have a larger or smaller diameter and, when there is more than one of them, these holes can have the same diameter or section (or through-area) or different diameters.

This plunger 3 and the vial 2 are of a plastics material and are obtained by injection moulding.

At the second end 11 of the plunger is a membrane filter 16 placed transversely to the longitudinal axis W of the plunger. According to the invention, this filter is secured directly to the tubular body 8 of the plunger 3 during the moulding thereof.

In other words, the body 8 is overmoulded onto the membrane filter 16 whose perimeter edge 17 is therefore "embedded", incorporated into or covered by the plastics material of said body; the filter 16 thus forms "one piece" with said body and cannot separate from it accidentally. The plunger with the filter is thus obtained by moulding in a single (thermal) operation (known as overmoulding or insert moulding).

At end 11, however, the plunger 3 has a support portion, which in FIG. 1 is shown as a radial portion 18, centred on the longitudinal axis W of the plunger, capable of protecting the filter 16 (located between the above-mentioned end and said portion 18) from the pressure that the fluid exerts upon it during the insertion of the plunger 3 into the vial 2. This support portion 18 has a plurality of arms projecting, at a first of their ends, from the body 8 of the plunger towards the axis W thereof and a second end connected to a common element 19 present in said axis. The position of the filter at the end 11 allows the "dead" space in the plunger to be reduced: the filter being located at the end of the plunger, when the latter is fully inserted into the vial, the filter 16 reaches up to the end 5 of the vial thus minimising the quantity of residual liquid in the vial which, with the solutions currently known, remains between the bottom of the cavity 7 of said vial 2 and the filter or membrane 16.

Clearly, the support portion 18 is moulded with the remaining part of the plunger 3 and so, according to the invention, is preferably fixed to the filter during the moulding of the body 8. This makes said filter "incorporated" or in any case integral with the arms of said portion 18, so as to enable the latter mechanically to withstand the pressure of the fluid in the vial 2 when the plunger moves relatively therein.

According to a variation, the support portion can have a cross or grid shape or other appropriate shape to support the membrane filter 16 and at the same time enable the fluid to pass from the vial 2 to the plunger 3. In other words, this support portion (or support body) 8 has in any case solid parts positioned transversely to the axis W or to the cavity 13 of the plunger (the above-mentioned arms) alternated by openings through which the above-mentioned fluid passes.

Furthermore, thanks to this solution, it is impossible for the fluid contained in the vial to leak between the filter 16, the body 8 and the vial 2 when the plunger 3, by known methods, is pressed into the vial in order to withdraw the fluid contained therein.

The body 8 also has an external collar 20 capable of sealing on an internal wall 21 of the vial 2 delimiting the cavity 7 during the movement of the second end 11 of the plunger 3 therein.

Thanks to the invention, the mini-vial is obtained with a reduced number of components compared with known vials, which contains its cost and makes it quicker to produce. Furthermore, as the filter is connected to the plunger directly during the production phase thereof, there is no risk in the production solutions and in the state-of-the-art mini-vials that its subsequent connection to said plunger will cause damage thereto, incorrect positioning or the release of material that could pollute the fluid contained in the vial.

The invention claimed is:

1. A method for producing a mini-vial comprising a tubular vial, having a closed end and an open end and capable of containing a product in a fluid phase within one of its internal cavities, a plunger sealingly movable within the tubular vial through said open end, said plunger having a tubular body defining an internal cavity capable of receiving the fluid phase from said tubular vial through movement or insertion of the plunger therein, the plunger tubular body having a first end on which is placed a sealing cap and a second end movably slidable in the tubular vial, wherein the plunger has a support body housed within the internal cavity of the plunger within a terminal portion of the plunger at the second end of the plunger, the support body being centered on the longitudinal axis (W) of the plunger and having arms projecting, at first ends, from the body of the plunger toward the longitudinal axis (W) of the plunger and second ends being located at said longitudinal axis (W), and a membrane filter directly contacting the plunger and being circumferentially surrounded by the terminal portion of the plunger at the second end of the plunger, the membrane filter being located transversely to a longitudinal axis (W) of the plunger, wherein the membrane filter has opposed first and second faces, the first face of said membrane filter being positioned directly against the support body housed within the internal cavity of the plunger, the second face of the membrane filter reaching up to the closed end of the tubular container or vial when the plunger is fully inserted in the tubular vial;

the method comprising:

obtaining said tubular container or vial by injection moulding of a plastics material, and obtaining said plunger by injection moulding of a plastics material in a single injection moulding operation to form a single piece containing the tubular body of the plunger and the membrane filter, wherein the membrane filter is secured directly to the tubular body of the plunger at the second end against the support body during the injection moulding of the tubular body of the plunger by overmoulding the second end of the plunger onto a perimeter edge of the membrane filter positioned transversely to a longitudinal axis (W) of the plunger to secure the membrane filter to the tubular body by embedding the perimeter edge of the membrane filter into the tubular body of the plunger at the second end of the plunger, wherein the membrane filter and the plunger form a single piece when overmoulded together, wherein the perimeter edge of the membrane filter is incorporated into the body of the plunger, said support body also being fixed to the first face of the membrane filter during the single injection moulding operation.

2. A mini-vial comprising:

a tubular vial having a closed end and an open end that is capable of containing a fluid within an internal cavity, and a plunger sealingly movable within the tubular vial through said open end, said plunger having a tubular body defining an internal cavity capable of receiving said fluid from said tubular vial when said plunger penetrates into the tubular vial, the plunger tubular body having a first end capable of cooperating with a sealing cap and a second end capable of penetrating into the tubular vial with movement of the plunger therein, wherein the plunger has a support body housed within the internal cavity of the plunger within a terminal portion of the plunger at the second end of the plunger, the support body being centered on the longitudinal axis (W) of the plunger and having arms projecting, at first ends, from the body of the plunger toward the longitudinal axis (W) of the plunger and second ends being located at said longitudinal axis (W), and a membrane filter directly contacting the plunger and being circumferentially surrounded by the terminal portion of the plunger at the second end of the plunger, the membrane filter positioned transversely to the longitudinal axis (W) of the plunger, wherein the membrane filter has opposed first and second faces, the first face of the membrane filter being positioned directly against the support body housed within the internal cavity of the plunger, the second face of the membrane filter reaching up to the closed end of the tubular vial when the plunger is fully inserted in the tubular vial, the second end of the plunger being overmoulded by injection molding onto a perimeter edge of the membrane filter positioned transversely to a longitudinal axis (W) of the plunger to secure the membrane filter to the tubular body by embedding the perimeter edge of the membrane filter into the tubular body of the plunger at the second end of the plunger, wherein the membrane filter and the plunger form a single piece when overmoulded together, wherein the perimeter edge of the membrane filter is incorporated into the body of the plunger, said support body also being fixed to the first face of the membrane filter to form the single piece.

3. The method according to claim 1, wherein the perimeter edge of the membrane filter is incorporated into the body of the plunger, wherein the body of the plunger and the support body are overmoulded onto the membrane filter to fix said support body to the membrane filter to form the single piece.

4. The mini-vial according to claim 2, wherein the body of the plunger and the support body are overmoulded onto the membrane filter to fix said support body to the membrane filter to form the single piece.

5. The mini-vial according to claim 2, wherein said support body has solid parts located transversely to the internal cavity of the plunger alternated by openings for passage of the fluid in the internal cavity of the vial, said solid parts defining alternately a radial, cross, grid or similar configuration.

6. The mini-vial according to claim 2, wherein the sealing cap is connected forcibly to the first end of the body of the plunger.

7. The mini-vial according to claim 2, wherein the first end of the body of the plunger is threaded and cooperates with the sealing cap when the sealing cap is screwed onto the first end of the body of the plunger.

8. The mini-vial according to claim 2, wherein the first end of the body of the plunger is bayonet-connected to the sealing cap.

9. The mini-vial according to claim 2, wherein there is at least one vent hole in the body of the plunger.

10. The mini-vial according to claim 9, wherein the body of the plunger comprises a plurality of vent holes, said vent holes having alternatively a through-section or area that is identical with the other or sections that are different from each other.

11. The mini-vial according to claim 2, wherein the tubular body of the plunger extends an entire length of the plunger.

12. The method according to claim 1, wherein the tubular body of the plunger extends an entire length of the plunger.

13. The method according to claim 1, wherein said plunger is obtained by injection moulding of the plastics material in the single injection moulding operation to form the single piece containing the tubular body of the plunger, the support body, and the membrane filter.

14. The method according to claim 1, wherein, except for the embedded perimeter of the membrane filter, the second face of the membrane filter is unobstructed.

15. The mini-vial according to claim 2, wherein, except for the embedded perimeter of the membrane filter, the second face of the membrane filter is unobstructed.

16. The method according to claim 1, wherein said support body has solid parts located transversely to the internal cavity of the plunger alternated by openings for passage of the fluid in the internal cavity of the vial, said solid parts defining alternately a radial, cross, grid or similar configuration.

17. The method according to claim 1, wherein the sealing cap is connected forcibly to the first end of the body of the plunger.

18. The method according to claim 1, wherein the first end of the body of the plunger is threaded and cooperates with the sealing cap when the sealing cap is screwed onto the first end of the body of the plunger.

19. The method according to claim 1, wherein the first end of the body of the plunger is bayonet-connected to the sealing cap.

20. The mini-vial according to claim 2, wherein there is at least one vent hole in the body of the plunger.

* * * * *